US006652673B1

(12) United States Patent
Inoue et al.

(10) Patent No.: US 6,652,673 B1
(45) Date of Patent: Nov. 25, 2003

(54) ZIRCONIUM SYSTEM AMORPHOUS ALLOY

(75) Inventors: Akihisa Inoue, 11-806 Kawauchijyutaku, Kawauchimotohasekura 35, Aoba-ku, Sendai-shi, Miyagi (JP); Tao Zhang, Sendai (JP); Masahide Onuki, Miki (JP); Tetsuo Yamaguchi, Nishinomiya (JP)

(73) Assignees: Sumitomo Rubber Industries, Ltd., Kobe (JP); YKK Corporation, Tokyo (JP); Akihisa Inoue, Sendai (JP)

( * ) Notice: Subject to any disclaimer, the term of this patent is extended or adjusted under 35 U.S.C. 154(b) by 109 days.

(21) Appl. No.: 09/153,309

(22) Filed: Sep. 15, 1998

(30) Foreign Application Priority Data

Dec. 25, 1997 (JP) ..... 9-367626

(51) Int. Cl.[7] ..... C22C 45/00
(52) U.S. Cl. ..... 148/403; 164/113; 148/561
(58) Field of Search ..... 148/403, 561, 148/538; 420/423; 164/113

(56) References Cited

U.S. PATENT DOCUMENTS 5,032,196 A * 7/1991 Masumoto et al. ..... 148/403
5,711,363 A * 1/1998 Scruggs et al. ..... 164/113
5,797,443 A * 8/1998 Lin et al. ..... 164/4.1
5,980,652 A * 11/1999 Inoue et al. ..... 148/403
6,010,580 A * 1/2000 Dandliker et al. ..... 148/403

OTHER PUBLICATIONS

Inoue et al. "Forming and Characteristics of Zr–Ti–Al–TM System Bulk Amorphous Metal", Abstract of the Japan Institute of Metals (Autumn Convention 1997, published on Sep. 24, 1997), p 329.

* cited by examiner

*Primary Examiner*—George Wyszomierski
*Assistant Examiner*—Janelle Combs Morillo
(74) *Attorney, Agent, or Firm*—Armstrong, Westerman & Hattori, LLP

(57) ABSTRACT

A zirconium system amorphous alloy having a composition expressed by a general formula $Zr_{100-X-Y-a-b}Ti_xAl_yCu_aNi_b$ wherein a, b, X, and Y in the formula represent atomic percentage, and fulfill X<10, Y>5, Y<-(1/2)X+35/2, 15≦a≦25, and 5≦b≦15, the zirconium system amorphous alloy has an amorphous phase of more than 50 volume % of the alloy.

2 Claims, 7 Drawing Sheets

◎ Amorphous phase is sufficiently larger than 50 volume %

○ Amorphous phase is 50 volume % or slightly larger than 50 volume %

● Amorphous phase is less than 50 volume %

ZIRCONIUM SYSTEM AMORPHOUS ALLOY

BACKGROUND OF THE INVENTION

1. Field of the Invention

This invention relates to a zirconium system amorphous alloy having amorphous-forming ability.

2. Description of the Related Art

Conventionally, it is known that an amorphous alloy has excellent characteristics in terms of magnetic properties, mechanical properties, chemical properties, etc., in comparison with a crystal alloy. Many alloy compositions which can form an amorphous phase such as Fe systems, Ni systems, Co systems, Al systems, Zr systems, and Ti systems, have been developed.

Generally, an amorphous alloy is obtained by rapid cooling of an alloy in molten state. As manufacturing methods of an amorphous alloy, known as various methods such as a single roll method and a dual roll method for obtaining thin sheet, a method in which a thread of molten metal is poured into rotationally flowing cold liquid for obtaining thin wire, an atomizing method and a cavitation method for obtaining alloy powder.

However, most amorphous alloys obtained by these conventional methods are of small mass, and obtaining bulk material is difficult.

Therefore, amorphous alloys having excellent mechanical characteristics are rarely used as structural materials. For this reason, as methods for obtaining large bulk material, a method of extrusion working of amorphous powder having a supercooling liquid area, and a casting method with a copper mold have also been attempted. However, the extrusion working method does not reach for obtaining strength of thin sheet made at a stretch, and there are some drawbacks such as the need for many manufacturing process steps and the need for large manufacturing apparatus. In the casting method, molten metal is successively poured into the copper mold, and cooled surfaces under the melting point of the molten metal are thereby formed into layers. This generates cold shut, amorphous area of the molten metal is crystallized by heat of molten metal supplied later, and the product includes many defects. In addition, the product cannot be used as a bulk material (structural material) due to problems in strength greatly resultant from the defects.

Further, the amorphous state is not necessarily obtained in all alloy compositions, good forming ability of amorphous, mechanical characteristics, etc. are demonstrated in some definite alloy compositions. It has been found by experiments conducted by the inventors of the present invention with repetition of much trial and error, that a composition having the best amorphous characteristics obtained by one manufacturing method does not necessarily correspond to a composition with which the best amorphous is obtained in another manufacturing method.

It is therefore an object of the present invention to provide a zirconium system amorphous alloy which can be produced in bulk and which has excellent strength characteristics, is well-workable, and is usable as structural material.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Zirconium (Zr) system amorphous alloy of the present invention includes a composition expressed by a general formula: $Zr_{100-X-Y-a-b}$ $Ti_x$ $Al_y$ $Cu_a$ $Ni_b$, and composed of amorphous phase more than 50% in volume percentage where a, b, X, and Y represent atomic percentage, and fulfill $X<10$. $Y>5$. $Y<-(1/2)X+35/2$, $15 \leqq a \leqq 25$, and $5 \leqq b \leqq 15$.

The Zr system amorphous alloy of the present invention may be made by the manufacturing method described below.

Figure 1:
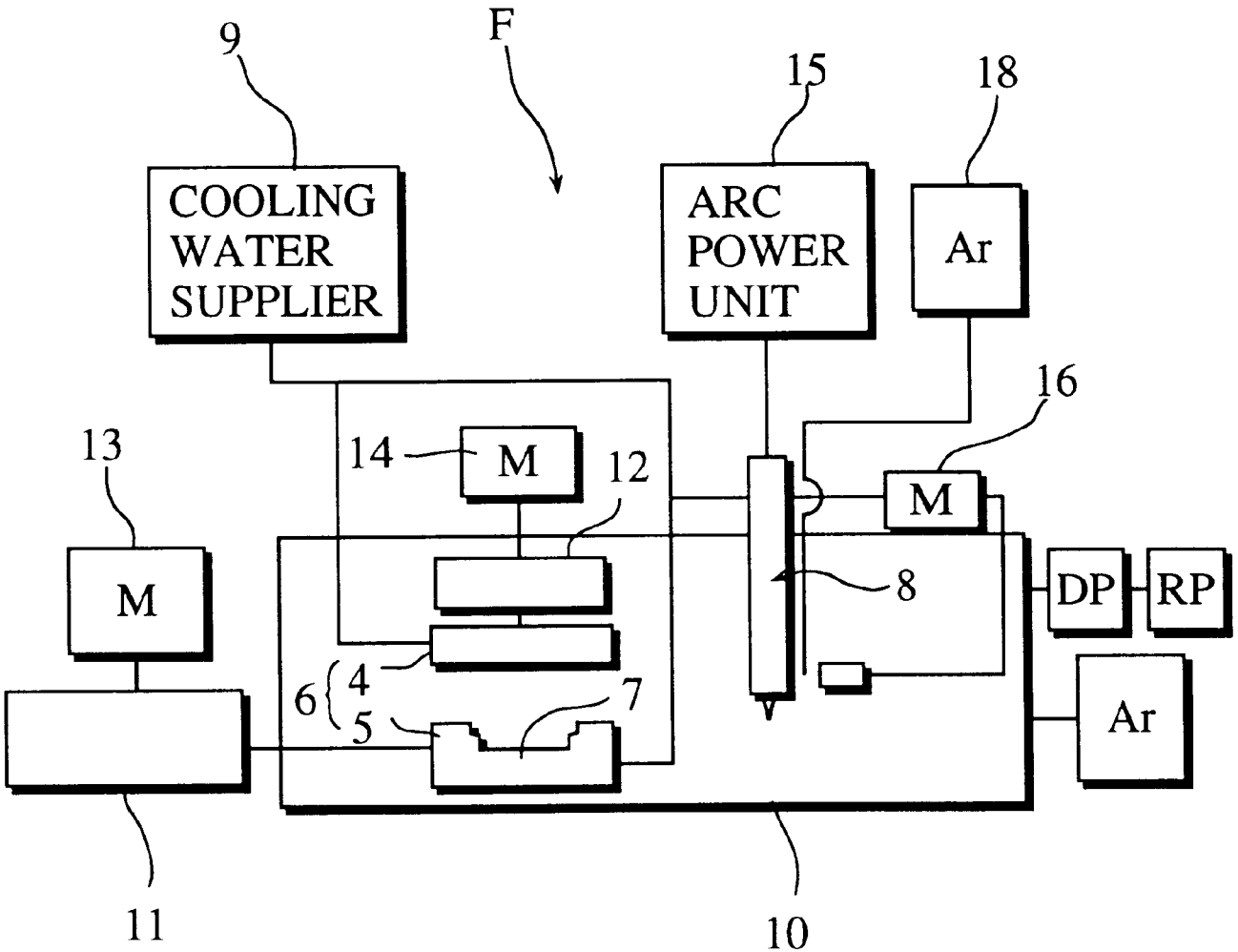
FIG. 1 is a block diagram of the construction of a manufacturing apparatus which can make Zr system amorphous alloy of the present invention.

FIG. 1 and FIG. 2 illustrate manufacturing apparatus F which can make the Zr system amorphous alloy of the present invention. Manufacturing apparatus F includes a press metal mold 6 having upper mold 4 and lower mold 5, an arc electrode (tungsten electrode) 8 for arc fusing of a metal material 26 placed on a cavity portion 7 of the lower mold 5, cooling water supplier 9 which circulates and supplies cooled water to the upper mold 4 and the lower mold 5 of the press metal mold 6 and the arc electrode 8. Manufacturing apparatus F includes vacuum chamber 10 which contains press metal mold 6 and arc electrode 8, lower mold moving mechanism 11 driven by motor 13 which moves lower mold 5 in the horizontal direction, and upper mold moving mechanism 12 driven by a motor 14 which moves the upper mold 4 in the vertical direction.

Press metal mold 6 has a configuration without engagement portions. More specifically, and as is shown in FIGS. 2A and 2C, the lower face of upper mold 4 is planar, lower mold 5 has planar cavity portion 7, and the lower face of upper mold 4 and the upper face of the lower mold 5 are parting faces fitting each other.

A manufacturing method of the Zr system amorphous alloy according to the present invention will be described. First, as shown in FIG. 1 and FIG. 2A, metal material 26 is placed on cavity portion 7 of lower mold 5. This metal material 26, namely, a material of the alloy composition expressed by the general formula above, may be a metal material of wire, belt, bar and lump form as far as rapid fusing is possible, although a powder or pellets are preferable for easier rapid fusing by a high energy heat source such as arc electrode 8 and an arc power unit shown in the FIGURE.

Figure 2A:
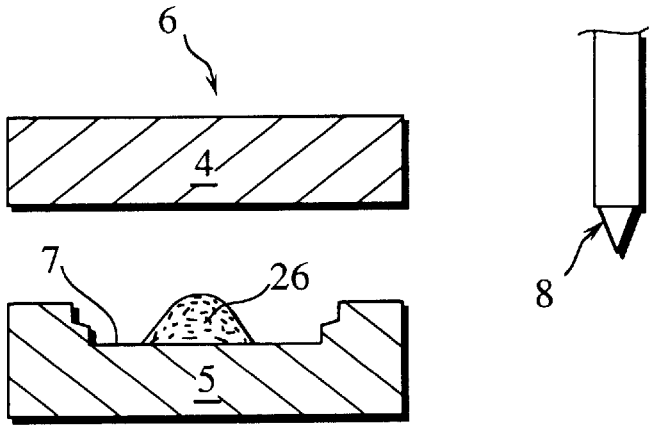
FIGS. 2A–2C are detailed cross-sectional views showing the manufacturing process for the Zr system amorphous alloy by the manufacturing apparatus of FIG. 1.
Figure 2B:
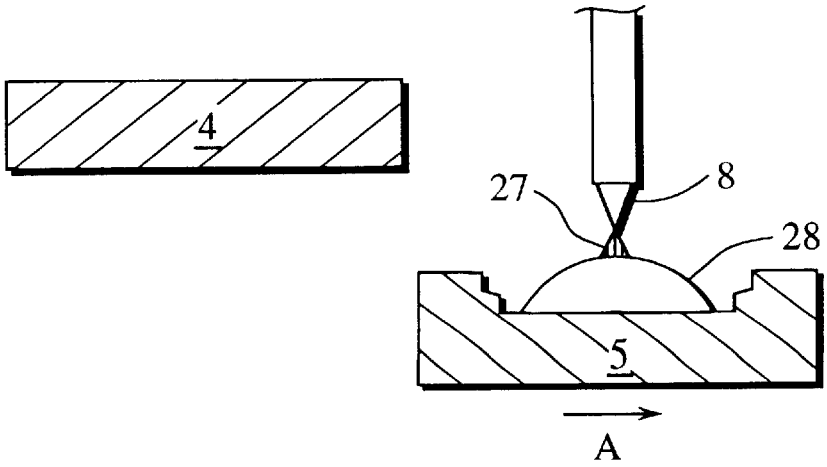

Next, as shown in FIG. 1 and FIGS. 2A and 2B, lower mold 5 is moved in a horizontal direction (a direction shown with an arrow A) by lower mold moving mechanism 11 driven by motor 13, and stopped at a position below the arc electrode 8. Then, the arc power unit is switched on, plasma arc 27 is generated from a tip of arc electrode 8 to metal material 26, so that the metal material is completely fused, and molten metal 28 is formed.

Figure 2C:
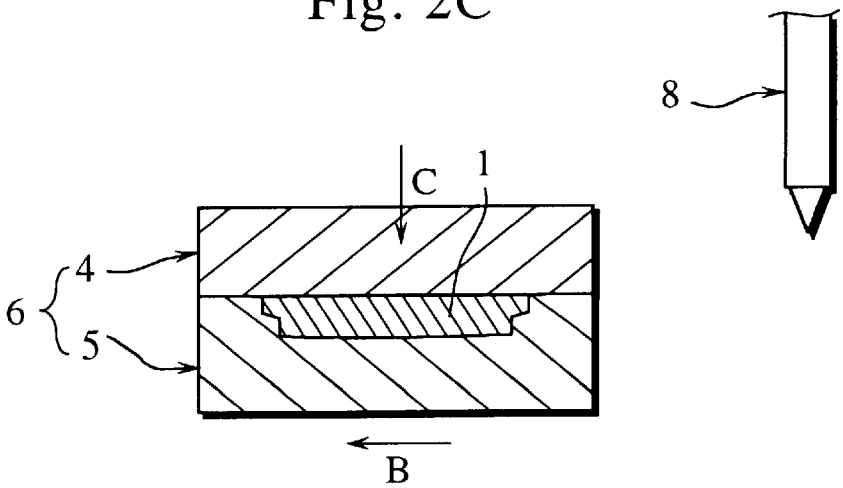
Figure 3:
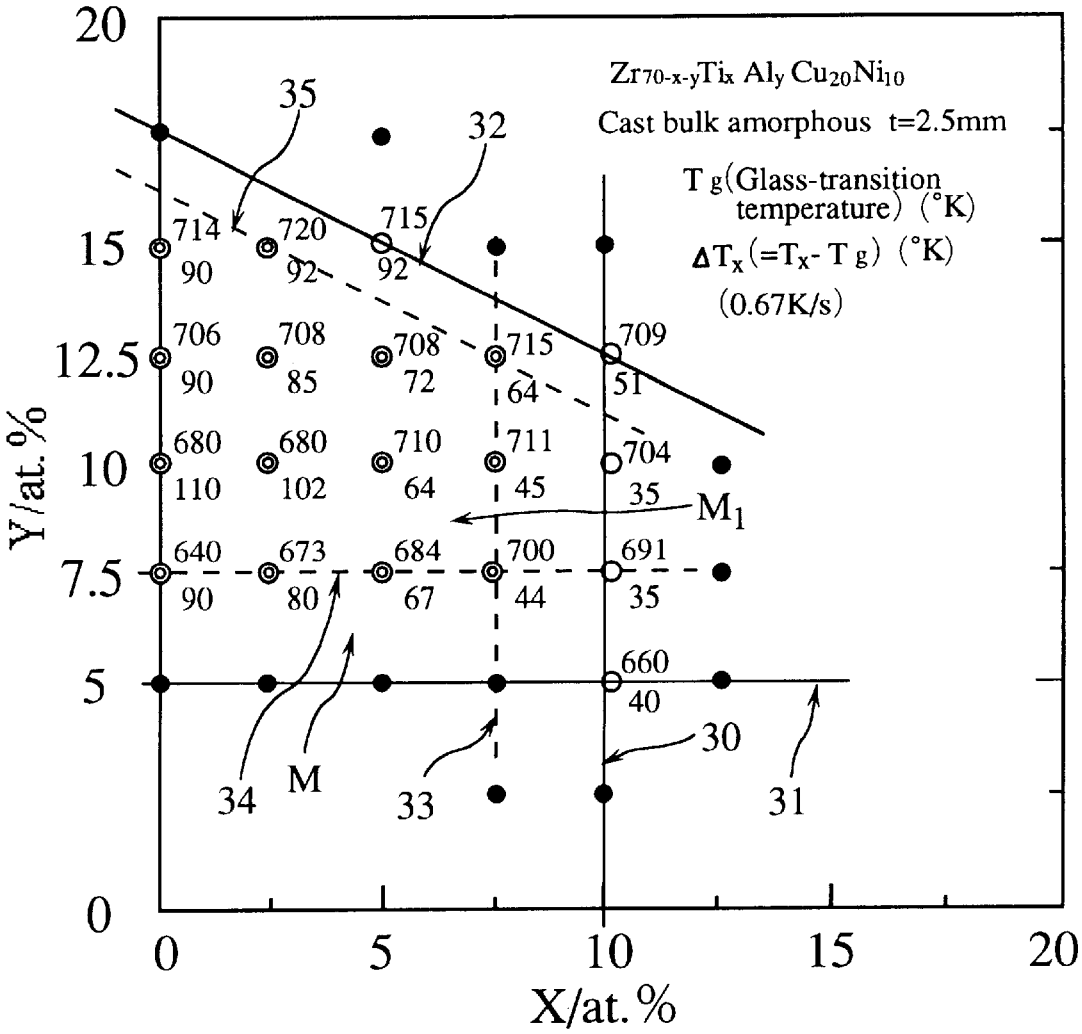
FIG. 3 is a graph showing experimental results of the volume percentage of amorphous phase of the obtained samples according to the present invention.
Figure 4:
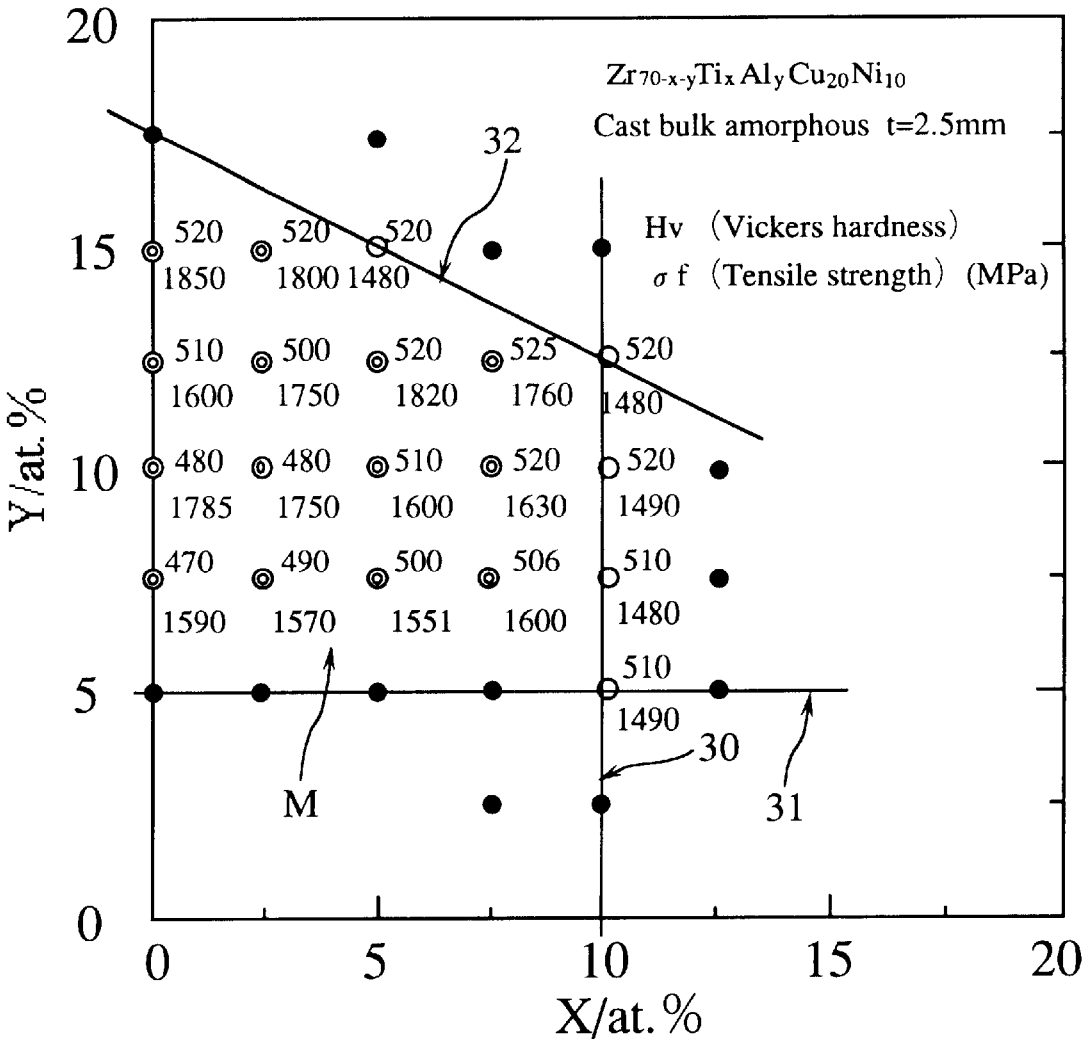
FIG. 4 is a graph showing experimental results of the Vickers hardness of the obtained samples according to the present invention.
Figure 5:
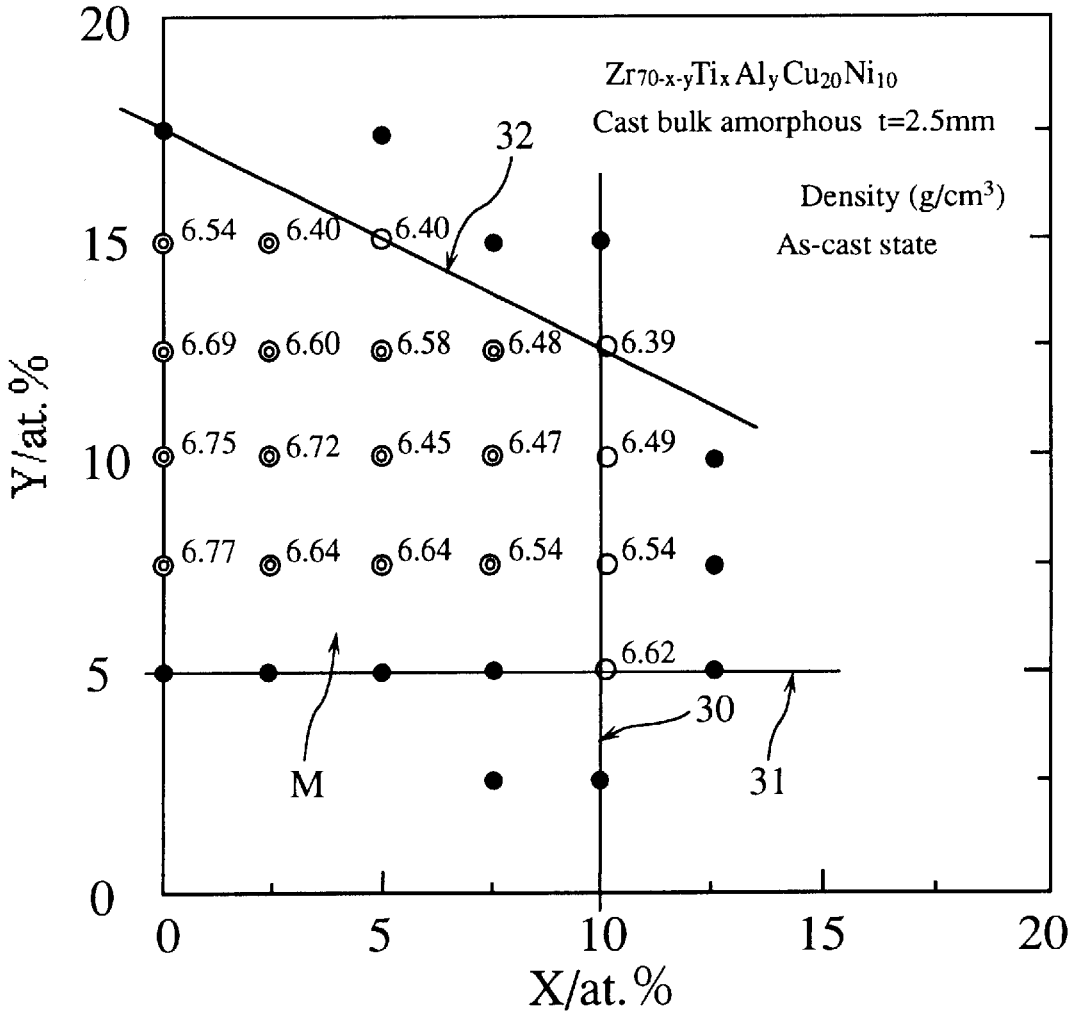
FIG. 5 is a graph showing experimental results of the density of the obtained samples according to the present invention.
Figure 6:
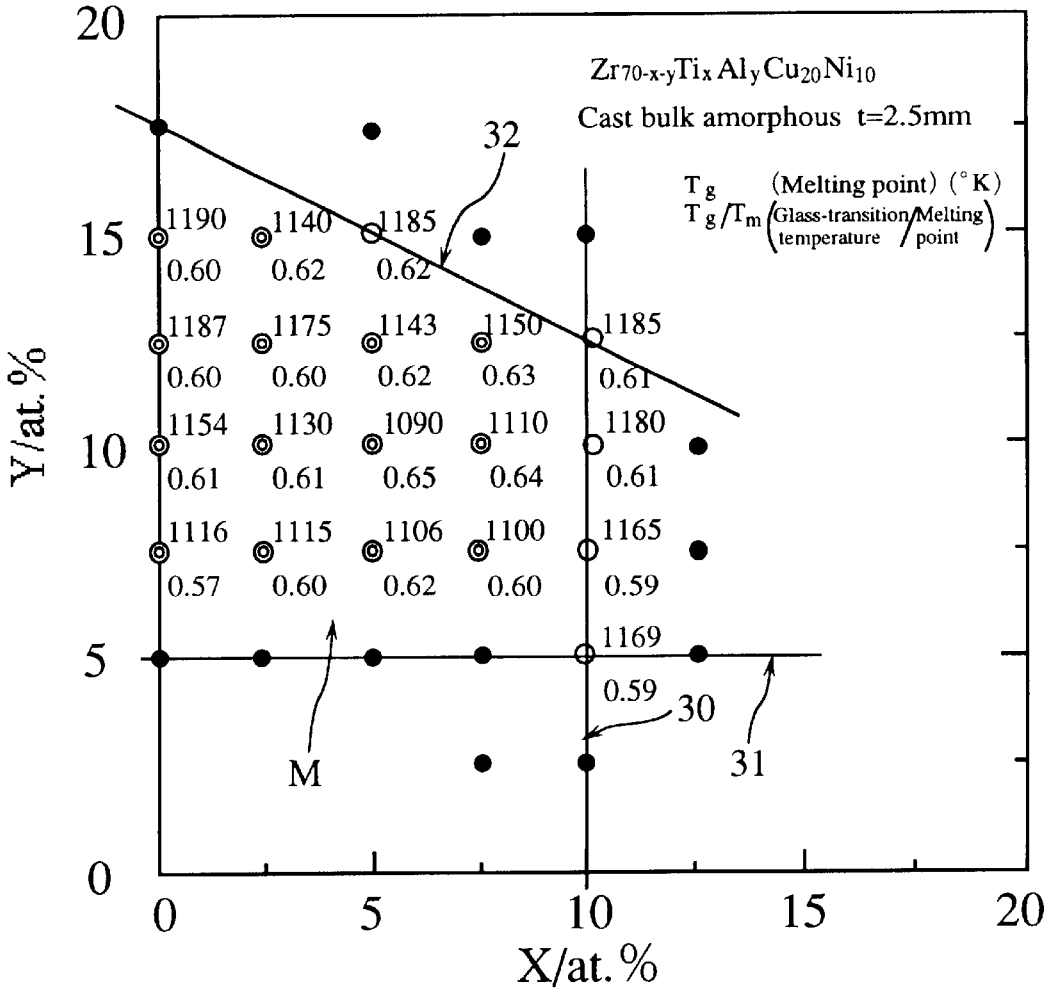
FIG. 6 is a graph showing experimental results of the melting point of the obtained samples according to the present invention.
Figure 7:
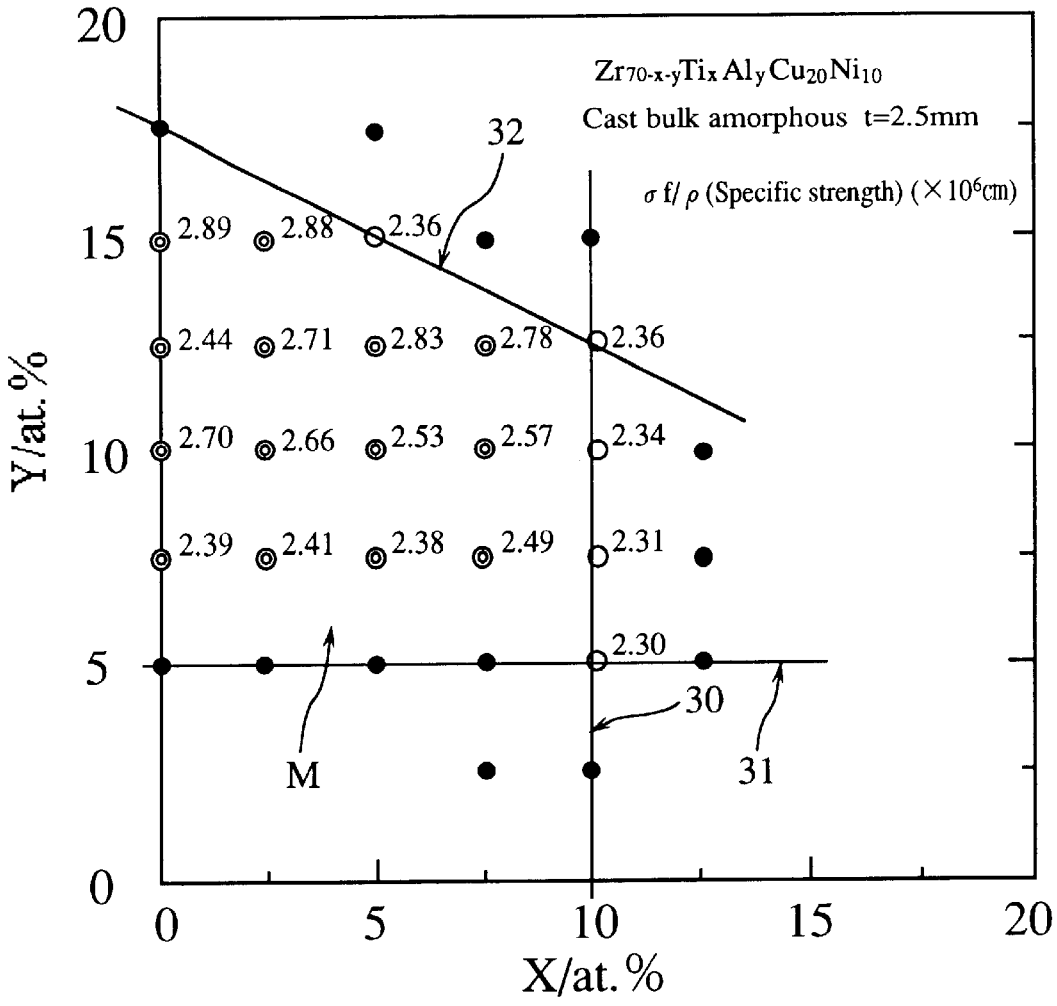
FIG. 7 is a graph showing experimental results of the specific strength of the obtained samples according to the present invention.

Thereafter, as shown in FIG. 1 and FIGS. 2B and 2C, the arc power unit is switched off, and thus plasma arc 27 is cut off. Lower mold 5 is moved to a position below upper mold 4 (in a direction shown with arrow B), upper mold 4 is caused to descend (in a direction shown with arrow C) by upper mold moving mechanism 12 and motor 14, and obtained molten metal 28 is transformed into a predetermined configuration by press pressure of upper mold 4 and lower mold 5. That is to say, compressive stress and shearing stress are added to molten metal 28. Molten metal 28 is cooled over a critical cooling rate by cooled press metal mold 6, and Zr system amorphous alloy 1 of a predetermined configuration is made thereby.

In this case, heat conductivity is extremely high, and the molten metal is effectively cooled. Because molten metal 28 contacts the press metal mold 6 with pressure, that is to say, the molten metal is pressed by upper mold 4 and lower mold 5 while the molten metal 28 has fluidity or until the molten metal solidifies. This differs greatly from the manufacturing method of the thin sheet in which the contact time of a cooling medium (a rotating roll, for example) and the molten metal is short, and also differs greatly form the casting method in which contact of the molten metal and the mold is not sufficiently maintained for a long enough time for contraction generated when the rapid-cooled molten metal solidifies. Because of these differences, the alloy compositions of the present invention demonstrate excellent amorphous forming ability with a high rate Tg/Tm of glass-transition temperature Tg (° K.) to melting point Tm (° K.), especially those obtained by the manufacturing method described with reference to FIG. 1 and FIG. 2 and a large molded product can be obtained.

The Zr system amorphous alloys 1 obtained as described above have excellent mechanical characteristics (Vickers hardness, tensile strength, etc.). Further, temperature range ΔT=Tx−Tg of the super-cooled liquid area, expressed by difference between the crystallizing temperature Tx and the glass-transition temperature Tg, is wide, and this characteristic makes the amorphous alloy 1 plastically deformable in an amorphous state. That is to say, the amorphous alloy 1 has excellent strength characteristics, plastic workability, and can be utilized as an excellent structural material.

Although the Zr system amorphous alloys of the present invention, having a composition expressed by a general formula: $Zr_{100-X-Y-a-b}\,Ti_xAl_yCu_aNi_b$ (wherein X, Y, a, and b in the formula represent atomic percentage) and composed of an amorphous phase of more than 50 volume %, which fulfills X<10, Y>5, Y<−(1/2)X+35/2, 15≦a≦25, and 5≦b<15, the alloys preferably fulfill X≦7.5. Y≧7.5, and Y≦−(1/2)X+65/4. Especially, the temperature range ΔT of the super-cooled liquid area becomes more than 40° K. by X≦7.5. With this latter condition, the temperature of the obtained amorphous alloy can be easily controlled within the temperature range of the supercooled liquid area, and plastic working thereby becomes easy. If X≧10, Y≦5, and Y≧−(1/2)X+35/2, the amorphous phase is (even in a case of more than 50 volume %) around 50 volume % of the Zr system amorphous alloy, or less than 50 volume % of the Zr system amorphous alloy. Therefore, problems are generated in terms of strength.

Next, the examples will be described.

A material having an alloy composition ($Zr_{70-x-y}\,Ti_x\,Al_y\,Cu_{20}\,Ni_{10}$) shown in Table 1 is, as shown with reference to FIG. 1 and FIG. 2, heated and melted by arc discharge, press-molded, and made into samples of a plate-shape of which thickness dimension t is 2.5 mm, is composed of a Zr system amorphous alloy. For each obtained sample, the properties of density, Vickers hardness (Hv), tensile strength (σf), temperature range of supercooled liquid area (ΔT), ratio (Tg/Tm) of glass transition temperature (Tg) to melting point (Tm), specific strength (σf/ρ), and volume percentage of amorphous phase are measured, and results are shown in Table 1 and FIGS. 3 through 7. Those samples which deviate from the range of the alloy compositions of the present invention are shown in Table 2 as comparison examples.

TABLE 1

EXAMPLES

| COMPOSITION ($Zr_{10-x-y}Ti_xAl_yCu_{20}Ni_{18}$) | DENSITY ρ (g/cm$^2$) | Hv (°) | σf (MPa) | ΔT (°K) | Tg/Tm | AMOR-PHOUS STATE | SPECIFIC STRENGTH (σf/ρ) (×10$^8$ cm) |
|---|---|---|---|---|---|---|---|
| ○x = 0% | | | | | | | |
| $Zr_{62.9}Al_{7.6}Cu_{20}Ni_{16}$ | 6.77 | 470 | 1590 | 90 | 0.57 | ○ | 2.39 |
| $Zr_{68}Al_{10}Cu_{20}Ni_{16}$ | 6.75 | 480 | 1785 | 110 | 0.61 | ○ | 2.70 |
| $Zr_{57.5}Al_{12.5}Cu_{20}Ni_{10}$ | 6.69 | 510 | 1600 | 90 | 0.60 | ○ | 2.44 |
| $Zr_{58}Al_{18}Cu_{20}Ni_{10}$ | 6.54 | 520 | 1850 | 90 | 0.60 | ○ | 2.89 |
| ○x = 2.5% | | | | | | | |
| $Zr_{68}Ti_{1.5}Al_{1.5}Cu_{26}Ni_{16}$ | 6.64 | 490 | 1570 | 80 | 0.60 | ○ | 2.41 |
| $Zr_{57.8}Ti_{2.6}Al_{18}Cu_{20}Ni_{10}$ | 6.72 | 480 | 1750 | 102 | 0.61 | ○ | 2.66 |
| $Zr_{55}Ti_{2.8}Al_{12.6}Cu_{20}Ni_{10}$ | 6.60 | 500 | 1750 | 85 | 0.60 | ○ | 2.71 |
| $Zr_{55.8}Ti_{2.5}Al_{16}Cu_{20}Ni_{10}$ | 6.40 | 520 | 1800 | 92 | 0.62 | ○ | 2.88 |
| ○x = 5% | | | | | | | |
| $Zr_{57.5}Ti_5Al_{7.5}Cu_{20}Ni_{10}$ | 6.64 | 500 | 1551 | 67 | 0.62 | ○ | 2.38 |
| $Zr_{55}Ti_5Al_{10}Cu_{20}Ni_{10}$ | 6.45 | 510 | 1600 | 64 | 0.65 | ○ | 2.53 |
| $Zr_{55.5}Ti_5Al_{15.8}Cu_{20}Ni_{10}$ | 6.58 | 520 | 1820 | 72 | 0.62 | ○ | 2.83 |

TABLE 1-continued

EXAMPLES

| COMPOSITION ($Zr_{10-x-y}Ti_xAl_yCu_{20}Ni_{18}$) | DENSITY ρ (g/cm²) | Hv (°) | σf (MPa) | ΔT (°K) | Tg/Tm | AMOR-PHOUS STATE | SPECIFIC STRENGTH (σf/ρ) (×10⁸ cm) |
|---|---|---|---|---|---|---|---|
| ○x = 7.5% | | | | | | | |
| $Zr_{68}Ti_{1.8}Al_{7.6}Cu_{20}Ni_{10}$ | 6.54 | 506 | 1600 | 44 | 0.60 | ○ | 2.49 |
| $Zr_{62.8}Ti_{1.8}Al_{16}Cu_{20}Ni_{10}$ | 6.47 | 520 | 1630 | 45 | 0.64 | ○ | 2.57 |
| $Zr_{50}Ti_{1.8}Al_{18.8}Cu_{20}Ni_{10}$ | 6.48 | 525 | 1760 | 54 | 0.63 | ○ | 2.78 |

○ amorphous phase is sufficiently larger than 50 volume %
⊙ amorphous phase is 50 volume % or slightly larger than 50 volume %
● amorphous phase is less than 50 volume %

TABLE 1

COMPARISON EXAMPLES

| COMPOSITION ($Zr_{10-x-y}Ti_xAl_yCu_{20}Ni_{18}$) | DENSITY ρ (g/cm²) | Hv (°) | σf (MPa) | ΔT (°K) | Tg/Tm | AMOR-PHOUS STATE | SPECIFIC STRENGTH (σf/ρ) (×10⁸ cm) |
|---|---|---|---|---|---|---|---|
| ○x = 0% | | | | | | | |
| ○x = 0% | | | | | | | |
| $Zr_{28}Al_5Cu_{20}Ni_{10}$ | | | | | | ● | |
| $Zr_{55.5}Al_{12.6}Cu_{20}Ni_{10}$ | | | | | | ● | |
| ○x = 2.5% | | | | | | | |
| $Zr_{52.5}Ti_{2.5}Al_8Cu_{20}Ni_{10}$ | | | | | | ● | |
| ○x = 5% | | | | | | | |
| $Zr_{55}Ti_5Al_5Cu_{20}Ni_{10}$ | | | | | | ● | |
| $Zr_{56}Ti_5Al_{55}Cu_{20}Ni_{10}$ | 6.40 | 520 | 1480 | 92 | 0.62 | ○ | 2.38 |
| $Zr_{67.5}Ti_5Al_{17.9}Cu_{20}Ni_{10}$ | | | | | | ● | |
| ○x = 7.5% | | | | | | | |
| $Zr_{56}Ti_{7.5}Al_{5.5}Cu_{20}Ni_{10}$ | | | | | | ● | |
| $Zr_{57.5}Ti_{7.5}Al_5Cu_{20}Ni_{10}$ | | | | | | ● | |
| $Zr_{67.5}Ti_{7.5}Al_{55}Cu_{20}Ni_{10}$ | | | | | | ● | |
| ○x = 10% | | | | | | | |
| $Zr_{57.5}Ti_{10}Al_{2.5}Cu_{80}Ni_{10}$ | | | | | | ● | |
| $Zr_{55}Ti_{10}Al_5Cu_{20}Ni_{10}$ | 6.62 | 510 | 1490 | 40 | 0.59 | ○ | 2.30 |
| $Zr_{52.5}Ti_{10}Al_{1.5}Cu_{20}Ni_{10}$ | 6.54 | 510 | 1480 | 35 | 0.59 | ○ | 2.34 |
| $Zr_{50}Ti_{10}Al_{10}Cu_{20}Ni_{10}$ | 6.49 | 520 | 1490 | 35 | 0.61 | ○ | 2.36 |
| $Zr_{47.5}Ti_{10}Al_{12.5}Cu_{20}Ni_{10}$ | 6.39 | 520 | 1480 | 51 | 0.61 | ○ | 2.31 |
| $Zr_{45}Ti_{55}Al_{15}Cu_{20}Ni_{10}$ | | | | | | ● | |
| ○x = 12.5% | | | | | | | |
| $Zr_{55.5}Ti_{12.5}Al_5Cu_{20}Ni_{10}$ | | | | | | ● | |
| $Zr_{50}Ti_{12.5}Al_{2.5}Cu_{20}Ni_{10}$ | | | | | | ● | |
| $Zr_{47.5}Ti_{12.5}Al_{10}Cu_{20}Ni_{10}$ | | | | | | ● | |

○ amorphous phase is sufficiently larger than 50 volume %
⊙ amorphous phase is 50 volume % or slightly larger than 50 volume %
● amorphous phase is less than 50 volume %

Results of the measurements on each sample composed of the Zr system amorphous alloys of the present invention are shown within a range M surrounded by graph lines 30, 31, and 32 (not including the border on the graph lines 30, 31, and 32). Graph line 30 represents X=10, graph line 31 represents Y=5, and the graph line 32 represents Y=−(1/2)X+35/2. As clearly shown in FIG. 3, the samples within the range M (samples of ⊙) have compositions in which amorphous phase is more than 50 volume %, and, in samples (of ⊙) within a range M, surrounded by graph lines 33, 34, and 35 (including the graph lines 33, 34, and 35), a venation pattern indicating toughness appears on broken-out sections in the tensile test. Further, the samples have high strength such as a tensile strength of more than 1500MPa, and a specific strength more than $2.38\times10^6$ cm. Graph line 33 represents X=7.5, graph line 34 represents Y=7.5, and the graph line 35 represents Y=−(1/2)X+65/4. To the contrary, the samples of the comparison examples (samples of ○ and ●) are out of the range M. Although samples of ○have an amorphous phase of approximately 50 volume %, a venation pattern does not appear on the broken-out section, and the strength is fairly low in comparison with the samples of e . In addition, the samples of ● have an amorphous phase of less than 50 volume %, which is smaller than the amorphous phase of ○, and only insufficient strength is obtained.

Although the samples of blank portions in Table 2 are not measured, they are anticipated always to be inferior to the products of the alloy compositions of the present invention. In addition, the specific strength is preferred to be more than $2.53\times10^6$ cm, and such is achieved by $Y\geqq10$. Further, to achieve the melting point, density, and Vickers hardness of the amorphous alloy within the range M, the larger X is the lower the melting point, the lower the density, and the higher the Vickers hardness. Therefore, $X\geqq2.5$ is preferred, and further, $X\geqq5$ is more preferred.

According to the zirconium system amorphous alloys of the present invention, the alloy composition becomes that amorphous can be obtained even if cooling speed is relatively slow. That is to say, molded product (amorphous alloy) obtained with conventional cooling speed can be enlarged. Further, Zr system amorphous alloy of the present invention can be widely used as an excellent structural material having excellent strength characteristics (especially, specific strength), excellent workability, and stable amorphous forming ability.

In addition, the Zr system amorphous alloys, which are excellent in strength characteristics and without defects such as cold shut, can be obtained with a simple production process and good repeatability in a short time.

Further, the Zr system amorphous alloys of larger mass can be obtained since molten metal 28 is pressed and transformed by the press metal mold 6, and effectively cooled by the upper mold 4 and the lower mold 5.

While preferred embodiments of the present invention have been described in this specification, it is to be understood that the invention is illustrative and not restrictive, because various changes are possible within the spirit and indispensable features of the invention.

What is claimed is:

1. A manufacturing method for zirconium system amorphous alloy, comprising the steps of:

melting metal by a high energy heat source;

pressing the molten metal in a press such that the molten metal does not form fitting cooling faces having a temperature under melting point of the molten metal;

transforming the molten metal at a temperature over the melting point into a predetermined configuration by applying at least one stress selected from compressive stress and shearing stress; and cooling the molten metal at over a critical cooling rate simultaneously with or after the transformation to make the zirconium system amorphous alloy in the predetermined configuration which has a composition expressed by a general formula: $Zr_{100-x-y-a-b}\ Ti_x\ Al_y\ Cu_a\ Ni_b$ (marks a, b, x, and y in the formula represent atomic percentage, and they fulfill $X<10$, $Y>5$, $Y<-(1/2)X+35/2$, $15\leqq a\leqq25$, and $5\leqq b\leqq15$), and which has an amorphous phase of more than 50 volume % of the alloy, a tensile strength higher than 1550 MPa, and a specific strength higher than $2.38\times10^6$ cm.

2. A manufacturing method for zirconium system amorphous alloy, comprising the steps of:

melting metal by a high energy heat source;

pressing the molten metal in a press metal mold such that the molten metal does not form fitting cooling faces having a temperature under melting point of the molten metal to transform the molten metal into a predetermined configuration; and cooling the molten metal over a critical cooling rate simultaneously with or after the transformation to make the zirconium system amorphous alloy into the predetermined configuration which has a composition expressed by a general formula: $Zr_{100-x-y-a-b}\ Ti_x\ Al_y\ Cu_a\ Ni_b$ (marks a, b, x, and y in the formula represent atomic percentage, and they fulfill $X<10$, $Y>5$, $Y<-(1/2)X+35/2$, $15\leqq a\leqq25$, and $5\leqq b\leqq15$), and which has an amorphous phase of more than 50 volume % of the alloy, a tensile strength higher than 1550 MPa, and a specific strength higher than $2.38\times10^6$ cm.

* * * * *